US009235972B2

(12) United States Patent
Hoffman et al.

(10) Patent No.: US 9,235,972 B2
(45) **Date of Patent: *Jan. 12, 2016**

(54) PERSONAL SECURITY AND TRACKING SYSTEM

(71) Applicant: Pragmatus Mobile LLC, Wayne, PA (US)

(72) Inventors: Mark Hoffman, Medfield, MA (US); Judd Hoffman, Medfield, MA (US); Ann Hoffman, Stoughton, MA (US); David Doe, Walpole, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/905,054

(22) Filed: May 29, 2013

(65) Prior Publication Data

US 2013/0307688 A1 Nov. 21, 2013

Related U.S. Application Data

(63) Continuation of application No. 13/404,977, filed on Feb. 24, 2012, now Pat. No. 8,466,795, which is a continuation of application No. 11/404,206, filed on Apr. 14, 2006, now Pat. No. 8,149,124, which is a (Continued)

(51) Int. Cl.
*G08B 23/00* (2006.01)
*G08B 21/02* (2006.01)
(Continued)

(52) U.S. Cl.
CPC ..... *G08B 21/02* (2013.01); *G08B 25/016* (2013.01); *G08B 25/08* (2013.01); *G08B 21/0261* (2013.01); *G08B 21/0283* (2013.01)

(58) Field of Classification Search
CPC .... G08B 25/009; G08B 25/016; G08B 21/02; G08B 21/0202; G08B 21/023; G08B 21/028; G08B 21/0283; G08B 21/0288; G08B 21/22; G08B 25/08
USPC ..... 340/573.1, 573.4, 539.1–539.13, 8.1; 379/37, 38; 455/404.1, 404.2, 456.1
See application file for complete search history.

(56) References Cited

U.S. PATENT DOCUMENTS 3,439,320 A 4/1969 Ward
4,244,045 A 1/1981 Nosu et al.
(Continued)

FOREIGN PATENT DOCUMENTS

AU 694442 7/1998
CA 1277400 12/1990
(Continued)

OTHER PUBLICATIONS

"Enabling Technologies for Mayday Systems" Dec. 13, 1996, I-95 Corridor Coalition; Virginia Polytechnic Institute & State University.
(Continued)

*Primary Examiner* — Thomas Mullen

(57) ABSTRACT

A signaling system is provided for rendering an alarm for an individual in distress combined with a locating and tracking system to thus alert and direct appropriate personnel to the needs of the individual in distress and to monitor the location of that individual. The system comprises a portable signaling unit, a remote alarm switch device, a central dispatch station, and makes use of a wireless communication system. The portable signaling unit and the remote alarm switch may be adapted to be worn at different locations on the person's body. The remote alarm switch way be concealed in the form of a wristband or in the form of any other object such as a broach, pendant, or keychain.

59 Claims, 9 Drawing Sheets

Related U.S. Application Data continuation of application No. 10/628,094, filed on Jul. 25, 2003, now Pat. No. 7,038,590, which is a continuation of application No. 09/284,598, filed as application No. PCT/US98/00896 on Jan. 20, 1998, now Pat. No. 6,624,754, which is a continuation-in-part of application No. 08/786,411, filed on Jan. 21, 1997, now Pat. No. 5,742,233, and a continuation-in-part of application No. 08/881,054, filed on Jun. 24, 1997, now Pat. No. 6,239,700.

(51) Int. Cl.
*G08B 25/08* (2006.01)
*G08B 25/01* (2006.01)

(56) References Cited

U.S. PATENT DOCUMENTS 4,539,557 A 9/1985 Redshaw
4,598,272 A 7/1986 Cox
4,675,656 A 6/1987 Narcisse
4,694,284 A 9/1987 Leveille et al.
4,718,080 A 1/1988 Serrano
4,744,083 A 5/1988 O'Neill et al.
4,799,062 A 1/1989 Sanderford, Jr. et al.
4,818,998 A 4/1989 Apsell et al.
4,819,860 A 4/1989 Hargrove et al.
4,833,477 A 5/1989 Tendler
4,837,700 A 6/1989 Ando
4,839,656 A 6/1989 O'Neill et al.
4,845,772 A 7/1989 Metroka
4,885,571 A 12/1989 Pauley et al.
4,908,629 A 3/1990 Apsell et al.
4,918,432 A 4/1990 Pauley et al.
4,924,402 A 5/1990 Ando
4,943,803 A 7/1990 Vrijkorte
4,952,913 A 8/1990 Pauley et al.
4,965,586 A 10/1990 O'Neill et al.
4,982,070 A 1/1991 Bezin
5,003,317 A 3/1991 Gray et al.
5,005,935 A 4/1991 Kunikane et al.
5,021,794 A 6/1991 Lawrence
5,025,261 A 6/1991 Ohta
5,027,314 A 6/1991 Linwood et al.
5,043,736 A 8/1991 Darnell et al.
5,045,839 A 9/1991 Ellis
5,087,919 A 2/1992 Odagawa
5,125,103 A 6/1992 Grube et al.
5,179,519 A 1/1993 Adachi et al.
5,196,825 A 3/1993 Young
5,218,367 A 6/1993 Sheffer et al.
5,223,844 A 6/1993 Mansell et al.
5,225,809 A 7/1993 Bunn
5,225,842 A 7/1993 Brown et al.
5,243,530 A 9/1993 Stanifer et al.
5,276,728 A 1/1994 Pagliaroli et al.
5,276,916 A 1/1994 Pawlish
5,299,132 A 3/1994 Wortham
5,334,974 A 8/1994 Simms et al.
5,357,254 A 10/1994 Kah, Jr.
5,365,450 A 11/1994 Schuchman et al.
5,369,690 A 11/1994 Comfort
5,381,462 A 1/1995 Larson et al.
5,396,227 A 3/1995 Carroll et al.
5,410,739 A 4/1995 Hart
5,416,468 A 5/1995 Baumann
5,418,537 A 5/1995 Bird
5,428,546 A 6/1995 Shah et al.
5,444,764 A 8/1995 Galecki
5,461,365 A 10/1995 Schlager et al.
5,461,390 A 10/1995 Hoshen
5,479,482 A 12/1995 Grimes
5,485,538 A 1/1996 Bowen et al.
5,497,149 A 3/1996 Fast
5,504,491 A 4/1996 Chapman
5,515,043 A 5/1996 Berard
5,515,285 A 5/1996 Garrett, Sr. et al.
5,515,419 A 5/1996 Sheffer
5,519,760 A 5/1996 Borkowski
5,544,225 A 8/1996 Kennedy, III et al.
5,552,772 A 9/1996 Janky et al.
5,554,993 A 9/1996 Brickell
5,555,286 A 9/1996 Tendler
5,557,254 A 9/1996 Johnson
5,559,520 A 9/1996 Barzegar et al.
5,561,712 A 10/1996 Nishihara
5,566,357 A 10/1996 Holeman
5,568,119 A 10/1996 Schipper
5,572,204 A 11/1996 Timm
5,587,701 A 12/1996 Hess
5,587,715 A 12/1996 Lewis
5,590,396 A 12/1996 Henry
5,594,425 A * 1/1997 Ladner et al. ..... 340/539.13
5,604,483 A 2/1997 Giangardella
5,629,693 A 5/1997 Janky
5,636,122 A 6/1997 Shah
5,640,147 A 6/1997 Chek et al.
5,649,059 A 7/1997 Tendler
5,650,770 A 7/1997 Schlager et al.
5,652,570 A * 7/1997 Lepkofker ..... 340/573.4
5,659,598 A 8/1997 Byrne
5,663,734 A 9/1997 Krasner
5,673,305 A 9/1997 Ross
5,682,133 A 10/1997 Johnson
5,682,139 A 10/1997 Pradeep et al.
5,686,902 A * 11/1997 Reis et al. ..... 340/8.1
5,689,252 A 11/1997 Ayanoglu et al.
5,699,056 A 12/1997 Yoshida
5,699,255 A 12/1997 Ellis et al.
5,712,619 A 1/1998 Simkin
5,712,899 A 1/1998 Pace
5,714,931 A 2/1998 Petite
5,722,067 A 2/1998 Fougnies
5,731,757 A * 3/1998 Layson, Jr. ..... 340/539.13
5,731,785 A 3/1998 Lemelson
5,739,772 A 4/1998 Nanba et al.
5,742,233 A 4/1998 Hoffman et al.
5,742,509 A 4/1998 Goldberg et al.
5,748,148 A * 5/1998 Heiser et al. ..... 340/573.4
5,758,313 A 5/1998 Shah
5,774,830 A 6/1998 Tsuji
5,777,580 A 7/1998 Janky
5,786,789 A 7/1998 Janky
5,796,365 A 8/1998 Lewis
5,797,091 A * 8/1998 Clise et al. ..... 455/404.2
5,808,551 A * 9/1998 Yarnall et al. ..... 340/573.4
5,808,564 A 9/1998 Simms et al.
5,822,427 A 10/1998 Braitberg et al.
5,838,237 A * 11/1998 Revell et al. ..... 340/573.1
5,864,305 A 1/1999 Rosenquist
5,874,889 A 2/1999 Higdon
5,874,914 A 2/1999 Krasner
5,877,724 A 3/1999 Davis
5,889,474 A 3/1999 LaDue
5,892,447 A * 4/1999 Wilkinson ..... 340/573.4
5,914,675 A * 6/1999 Tognazzini ..... 340/989
5,918,180 A 6/1999 Dimino
5,930,352 A 7/1999 Hiraiwa
5,938,718 A 8/1999 Morimoto et al.
5,959,529 A 9/1999 Kail, IV
5,963,130 A 10/1999 Schlager
5,999,124 A 12/1999 Sheynblat
6,002,363 A 12/1999 Krasner
6,072,396 A 6/2000 Gaukel
6,075,635 A 6/2000 Butrie et al.
6,088,636 A 7/2000 Chigumira et al.
6,121,922 A 9/2000 Mohan
6,127,945 A 10/2000 Mura-Smith
6,167,171 A 12/2000 Grasis et al.
6,198,857 B1 3/2001 Grasis et al.
6,202,060 B1 3/2001 Tran
6,212,312 B1 4/2001 Grann et al.
6,226,622 B1 5/2001 Dabbiere

(56) References Cited

U.S. PATENT DOCUMENTS

| | | | |
|---|---|---|---|
| 6,239,700 | B1 | 5/2001 | Hoffman et al. |
| 6,249,241 | B1 | 6/2001 | Jordan et al. |
| 6,252,719 | B1 | 6/2001 | Eichenbaum |
| 6,433,740 | B1 | 8/2002 | Gilhousen |
| 6,519,463 | B2 | 2/2003 | Tendler |
| 6,624,754 | B1 | 9/2003 | Hoffman et al. |
| 7,038,590 | B2 | 5/2006 | Hoffman et al. |
| 8,149,124 | B2 | 4/2012 | Hoffman et al. |
| 8,466,795 | B2 | 6/2013 | Hoffman et al. |
| 2001/0034573 | A1 | 10/2001 | Morgan et al. |

FOREIGN PATENT DOCUMENTS

| | | |
|---|---|---|
| EP | 0242099 | 10/1987 |
| EP | 0350554 | 11/1988 |
| EP | 0509775 | 10/1992 |
| EP | 0539143 | 4/1993 |
| EP | 0699361 | 3/1996 |
| EP | 0702820 | 3/1996 |
| JP | H04-287547 | 10/1992 |
| JP | H05-028377 | 2/1993 |
| JP | 1993-067113 | 3/1993 |
| JP | H05-067113 | 3/1993 |
| JP | H06-232797 | 8/1994 |
| JP | 1995-202790 | 8/1995 |
| JP | H07-202790 | 8/1995 |
| JP | 1995-240964 | 9/1995 |
| JP | H07-240964 | 9/1995 |
| JP | 1996-056377 | 2/1996 |
| JP | H08-056377 | 2/1996 |
| JP | H08-153075 | 6/1996 |
| JP | 1996-221696 | 8/1996 |
| JP | H08-221696 | 8/1996 |
| JP | 1996-317085 | 11/1996 |
| JP | H08-317086 | 11/1996 |
| KR | 0163215 | 9/1998 |
| WO | 8904031 | 5/1989 |
| WO | 9427163 | 11/1994 |
| WO | 96/05659 | 2/1996 |
| WO | 96-12264 | 4/1996 |
| WO | 9626614 | 8/1996 |

OTHER PUBLICATIONS

"Fleetcon: An Automatic Vehicle Location and Fleet Management Systemt" version 1.0, Arrowsmith Technologies, Inc 1301 West 25th Street, Suite 300 Austin, Texas 78705, Feb. 24, 1992.
"GPS/Cellular Messenger Installation and Operations Manual," Jun. 1995, Trimble Navigation Limited.
"In re Revision of the Comm'n Rules to Ensure Compatibility with Enhanced 911 Emergency Calling Sys.," 11 FCC Rcd. 18,676 Jul. 26, 1996.
"Nokia Cell Phone with 'Mayday' Emergency Transceiver," Collections Search Center, 1996, Smithsonian Institution.
"Summary of Mayday Initiatives" Sep. 12, 1996, I-95 Corridor Coalition; Virginia Polytechnic Institute & State University.
Alison Brown and Randy Silva "TIDGET Mayday System for Motorists," Apr. 1994, Naysys, IEEE Position Location and Navigation Symposium.
Alison Brown, "TIDGET-PLUS: Urban Navigation with Stand-Alone GPS," Sep. 1993, Naysys, ION Satellite Division 6th International Technical Meeting.
Bob Fultz "Messenger Ins. & Ops. Manual, Addendum—Voice Upgrade," May 23, 1997, Trimble Navigation Limited 645 North Mary Avenue Sunnyvale, CA 94086.
Bob Fultz, "Application Note #M0001," Oct. 15, 1996, Trimble Naviation Limited Limited Sunnyvale, CA USA.
Bob Fultz, "Updated TAIP Reference—Appendix A," May 27, 1997, Trimble Navigation Limited 645 North Mary Avenue Sunnyvale, CA 94086.
Bob Fultz, "Wizard User's Manual," May 22, 1997, Trimble Navigation Limited 645 North Mary Avenue Sunnyvale, CA 94086.
Dimitris A. Scapinakis et al., "Communications and Positioning Systems in the Motor Carrier Industry," Oct. 1991, Program on Advanced Technology for the Highway, Institute of Transportatio n Studies, University of California at Berkeley.
Irwin Jacobs, "The Application of a Novel Two-Way Mobile Satellite Communications and Vehicle Tracking System to the Transportation Industry," Feb. 1991, IEEE Transactions on Vehicular Technology.
John Greening, "Process Re-engineering Hones New Systems," Jun. 1995, Communications Engineering and Design.
John J. Harrington "Concepts and Applications of Wireless Security Systems for Tactical, Portable, and Fixed Sites" 1997.
Lacey et al., "Mayday in the Rockies: Colorado's GPS-Base Emergency Vehicle Location System," Oct. 1995, GPS World.
Nokia 9000 Communicator User's Manual, Oct. 1996.
Nokia 9000i Communicator User's Manual, Jun. 1998.
Roy Want and Andy Hopper, "Active Badges and Personal Interactive Computing Objects," Feb. 1992.
Shon Shampain, "GPS Phone an Integrated GPS/Cellular Handset," Naysys Corporation.
Shon Shampain, "LocatorNet System Overview" Oct. 16, 1997, Naysys Corporation.
Simon Applebaum, "The MIS Factor," Aug. 22, 1994, Cablevision Magazine.
Stan Horpeza, "Getting on Track with APRS: A Hands-On Guide to the Automatic Packet Reporting System," 1996, The American Radio Relay League, Inc., 225 Main Street, Newington, CT 06111-1494.
Zaf Siddiqi, "Application Note #M0004" Apr. 18, 1997, Trimble Naviation Limited Limited Sunnyvale, CA USA.
Trimble Navigation Limited, SEC Form 10-K, 1996 Annual Report.

* cited by examiner

| Situation | Activation Method | Information received, verified, displayed and stored at central dispatch station | | |
|---|---|---|---|---|
| | | Unit Serial/ID Number | Alarm Code | Location Coordi-nates |
| INITIATED FROM PORTABLE SIGNALING UNIT: | | | | |
| 1. Person 50 is able to alert the central dispatch station 80 by depressing one of several manual alarm push-button switches on portable signaling unit 20 relating to various health conditions or a threat to personal safety. | Manual alarm push-button switch 24a, 24b, 24c, etc. is depressed on portable signaling unit 20 which activates portable signaling unit 20 to alert central dispatch station 80. | XXXXXXX | 1A, 1B, 1C, Etc. | XX.XXXX YY.YYYY ZZZZ |
| 2. Person 50 is able to alert the central dispatch station 80 by depressing one of several manual alarm push-button switches on remote alarm switch unit 40 relating to various health conditions or a threat to personal safety. | Manual alarm push-button switch 42a, 42b, 42c, etc. is depressed on remote alarm switch unit 40. Radio transmitter 46 sends a unique code to receiver 116, decoded by decoder 118, which activates signaling unit 20 to alert central dispatch station 80. | XXXXXXX | 2A, 2B, 2C, Etc. | XX.XXXX YY.YYYY ZZZZ |
| 3. remote alarm switch unit 40 is forcibly removed from person 50 before he or she is able to summon help. | Automatic alarm switch circuit 44 is operated when remote alarm switch clasp is opened, or wristband is cut or broken. Radio transmitter 46 sends a unique code to receiver 116, decoded by decoder circuit 118, which then activates portable signaling unit 20 to alert central dispatch station 80. | XXXXXXX | 3 | XX.XXXX YY.YYYY ZZZZ |

FIG. 8A

| | | | | |
|---|---|---|---|---|
| 4. Portable signaling unit 20 is forcibly removed from person 50 before he or she is able to summon help. | Portable signaling unit 20 fails to receive a periodically transmitted signal from remote alarm switch 40 due to separation distance. A uniquely coded signal is normally detected at receiver 116 and decoded by decoder 118. If missing pulse detector 124 fails to be reset by the periodic signal, then microcontroller 106 senses this as an alarm state. Signaling unit 20 is then activated to alert central dispatch station 80. | XXXXXXX | 4 | XX.XXXX YY.YYY ZZZZ |
| 5. Low battery condition is sensed in portable signaling unit 20. | Low battery sensor circuit 122 activates portable signaling device 20 to alert the central dispatch center 80 that a low battery condition exists. There will be enough battery power remaining for limited operation. | XXXXXXX | 5 | XX.XXXX YY.YYY ZZZZ |
| INITIATED FROM CENTRAL DISPATCH STATION: | | | | |
| 6. Current location of person is desired. Information is requested by subscriber on an "as needed" basis such as locating a lost person. | Central dispatch station 80 activates portable signaling unit 20 via cellular telephone system 70 for a limited time to determine and display position of portable signaling unit 20. | XXXXXXX | 6 | XX.XXXX YY.YYY ZZZZ |
| 7. Person is to be monitored for compliance within preset boundary. | Central dispatch station 80 activates portable signaling unit 20 via cellular telephone system 70 at predetermined time intervals to track position of portable signaling unit 20 within preset boundaries. Alarm is activated at the central dispatch station if boundary limits are violated. | XXXXXXX | 6 | XX.XXXX YY.YYY ZZZZ |
| 8. Spot check to insure system is working and to compile historical data. | Central dispatch station activates portable signaling unit 20 via cellular telephone system 70 at predetermined time intervals. Central dispatch station 80 alarm is activated if there is no response or invalid data is received. | XXXXXXX | 6 | XX.XXXX YY.YYY ZZZZ |

FIG. 8B

PERSONAL SECURITY AND TRACKING SYSTEM

RELATED APPLICATIONS

This Application is a continuation of and claims priority under 35 U.S.C. §120 to U.S. application Ser. No. 13/404,977, filed on Feb. 24, 2012, entitled "Personal Security And Tracking System", now U.S. Pat. No. 8,466,795, which is incorporated herein by reference in its entirety, and which is a continuation of U.S. patent application Ser. No. 11/404,206, filed on Apr. 14, 2006, entitled "Personal Security and Tracking System", now U.S. Pat. No. 8,149,124, which is a continuation of U.S. patent application Ser. No. 10/628,094, filed on Jul. 25, 2003, entitled "Personal Security and Tracking System", now U.S. Pat. No. 7,038,590, which is a continuation of U.S. patent application Ser. No. 09/284,598, filed on Apr. 16, 1999, entitled "Personal Security and Tracking System", now U.S. Pat. No. 6,624,754, which is a National Stage application of, and claims priority under 35 U.S.C. §119(a) to PCT Application No. PCT/US98/00896, filed Jan. 20, 1998, which is a continuation-in part of U.S. patent application Ser. No. 08/881,054, filed on Jun. 24, 1997, now U.S. Pat. No. 6,239,700, and which is a continuation-in part of U.S. patent application Ser. No. 08/786,411, filed Jan. 21, 1997, now U.S. Pat. No. 5,742,233.

FIELD OF INVENTION

The present invention relates to a signaling system that enables an individual in distress to initiate an alarm to alert appropriate personnel combined with a locating and tracking system that enables the alerted personnel to monitor the location of the individual in distress.

BACKGROUND

We are constantly reminded of the need for personal security in today's society. All too often in the news we hear of missing persons and the dramatic searches which ensue. For each heroic story of a "just-in-time" rescue of a person who is abducted, lost, in a threatening situation, or in need of emergency medical care, there are many more personal dramas which unfortunately end in tragedy. It follows that immediate notification of an emergency situation and a prompt response from police, paramedics, fire department, or another service organization are essential for the well being of the individual.

Today's technology provides us with public services such as the 911 telephone number for rapidly summoning emergency help if we are able to access a telephone, dial the number, and communicate our location. However, these services fall short in the case of a young child, a mentally incompetent or medically incapacitated person, someone lost in the woods, or the victim of an abduction or kidnapping. These situations necessitate a security system that travels with the individual, is not limited in range, is able to define and signal an emergency situation without human intervention, and identifies the individual's location. Such a system would provide protection to the individual and peace of mind to those responsible for his or her care and well being.

A number of prior art devices have been proposed for use as personal alarms and tracking systems, as well as to automate the dispatch of proper authorities to a person in an emergency situation. U.S. Pat. No. 4,694,284 issued to Levelle et al. discloses a collar to prevent abduction. The Levelle et al. device does not allow the user to manually activate any one of several alarm states or levels. It relies on a wide range of available receivers, such as directional radio receivers, amateur radio receivers, or television receivers to give an approximate location of the collar, not the individual, once the collar is removed.

U.S. Pat. Nos. 4,744,083, 4,839,656, and 4,965,586 issued to O'Neill disclose variations of a system that uses positioning determining satellites in a geostationary orbit. This system is intended to be used to generate terrain maps, to test message transfer link signal quality, and for determining the elevation of an object by comparing transmitted information with a stored terrain map. It is not intended for use as a personal security system, nor is it capable of being so used.

U.S. Pat. No. 4,799,062 issued to Sanderford et al. discloses a radio position determination and apparatus based on measured times-of-arrival of radio signals from a plurality of land based transmitters. This patent is concerned with errors due to multipath (signal reflection) problems causing errors in locating the signal source.

U.S. Pat. No. 4,818,998 issued to Apsell et al. provides a system for tracking stolen motor vehicles, not individuals, using radio direction finding methods. This system is initiated only after a delay in reporting and verification through a national database of registered users of the system. The method of using radio direction finding techniques also delays locating the vehicle.

U.S. Pat. No. 4,819,860 issued to Hargrove et al. discloses a wrist mounted device for sensing vital functions. It is activated only when preset pulse rate and body temperature limits are exceeded. The user relies on an emergency aircraft locator beacon in order to be found. There is no provision for a manually activated security alarm.

U.S. Pat. Nos. 4,885,571, 4,918,432, and 4,952,913 issued to Pauley et al. describe methods of monitoring prisoners confined to a "house arrest." These methods are intended for use within the restricted limits of a field monitoring device.

U.S. Pat. No. 5,021,794 issued to Lawrence discloses a personal emergency locator using UHF radio direction finding and distance measuring equipment to find a person. This patent only provides for remote activation by a child's parent of the wearer's locating transmitter; it does not provide for the wearer to initiate the alarm. As in other prior art of this type, this device also relies on a time ¬ consuming method of radio direction finding techniques and skills to eventually locate the person wearing the alarm.

U.S. Pat. No. 5,027,314 issued to Linwood et al. describes a system and method for tracking a number of subjects, each wearing a personal infrared transmitter, detected by a plurality of receivers in a pre determined area. This system is limited to identification and tracking within line-of-sight in confined areas and does not lend itself for use in widespread geographical areas.

U.S. Pat. No. 5,196,825 issued to Young discloses an apparatus for monitoring the location of a person and determining whether the person is in distress using a transceiver and at least one remote receiver. In the monitor mode, the alarm activation apparatus must continuously transmit a signal which is used to activate the alarm. This feature has limitations due to the fact that the transmitter is always on, shortening the life of available battery power. Again, as in other references previously mentioned, the user must be located by radio direction finding equipment.

U.S. Pat. No. 5,225,809 issued to Bunn discloses a personal security system that requires constructing a plurality of automatic direction finding antennas in an appropriately organized and spaced relation within the geographical area to be monitored. Once a rough estimate of where the transmitting signal is located, a more precise location must be determined by the use of direction finding equipment.

U.S. Pat. No. 5,225,842 issued to Brown et al. discloses a vehicle or any other animate or inanimate object tracking and navigation system employing GPS satellites and a remote GPS receiver. Although the Brown et al. system uses GPS technology, it does provide the advantages of an optimal personal security system. Specifically, this system does not contemplate active and/or passive alarm signal generation by a personal security device.

U.S. Pat. No. 5,334,974 issued to Simms et al. discloses a fully automatic security system to be used to protect passengers in a motor vehicle. This system also lacks certain elements of an optimal personal security system, including the ability to provide personal security independent of a vehicle and the ability of a central station to initiate a status request of the mobile unit.

U.S. Pat. No. 5,357,254 issued to Kah, Jr. discloses a location monitoring system that utilizes a radio transmitter and a radio receiver to monitor the movement of a person or object. The receiver sounds an alarm at a predetermined time after failure to receive a signal. This system requires the use of a receiver to determine range and direction to locate the user. As in other prior art of this type, Kah, Jr. '254 also relies on using a method of radio direction- and range finding which takes time and skill to eventually locate the person wearing the alarm.

U.S. Pat. No. 5,396,227 issued to Carroll et al. discloses a system that monitors an individual for compliance with a protective order. The system is activated when the violator's transmitter is detected by the victim's receiving apparatus.

U.S. Pat. No. 5,461,390 issued to Hoshen addresses the problem for monitoring a number of prisoners within a specified boundary and is useful for "house arrest" and stalker detection. This patent relates to monitoring a subject's location and comparing the location listed on a database as to where the subject should be.

U.S. Pat. No. 5,515,419 issued to Sheffer describes a tracking system and method for tracking a movable object carrying a cellular phone unit. The phone unit includes a processor for generating the emergency signal. The location of the user is determined by the cellular phone system's identifying or control channel signals received by the phone and only gives a general location of the user.

U.S. Pat. No. 5,559,520 issued to Barzegar discloses an information system for automatically providing mobile vehicles dispatch information related to their geographical location. This system is described to provide routing information to vehicles, rather than to provide a personal security and tracking system for individuals.

Despite the above described tracking and security devices and systems, it is important to note that the prior art generally is limited to transmitting an alarm, the source of which is located by a complex array of antennas or by a direction finding receiver, either of which would require undue time to locate a person in distress.

Systems utilizing GPS technology for tracking vehicles have not fully addressed the requirements of a portable, personal security system. Nor do extant systems, developed for tracking a person, that are limited to applications such as monitoring prisoners within range of a field monitoring device.

Current available technology does not address the case of an individual who is helpless in an emergency situation where information is required so that the appropriate authorities can respond quickly and efficiently to a distress signal generated by the individual. Providing personal security for persons at risk demands a fully automated and responsive system for summoning assistance.

In order to meet the demands created by a situation where an individual with limited time, opportunity, or ability to generate a distress signal encounters danger, becomes lost, or experiences another condition that requires assistance, the ideal personal security and tracking system will comprise an alarm trigger and separate signaling unit, such that the signaling unit will generate an alarm signal in response to activation of the alarm trigger to enable a locating system to identify the location of the signaling unit, which should remain with the individual. The alarm could be generated by the individual directly, as by manual activation of the alarm trigger or manual activation of the signaling unit itself, or indirectly, as where the alarm trigger is removed from the individual or where the portable signaling unit becomes separated from the alarm trigger by a predetermined distance, thereby automatically generating an alarm signal. The ideal system should further allow for the generation of varying levels of alarm signals.

Further, the ideal system would use a locating system that does not constrain an individual to a given geographical area and that contains multiple redundancies to provide for faster, more accurate, and more reliable signal source location information than do known systems and devices.

SUMMARY OF THE PRESENT INVENTION

Accordingly, it is an object and advantage of the present invention to provide a personal security and tracking system for individuals which quickly and accurately provides a central dispatch station with data identifying the type of alarm and the location of an individual.

It is another object and advantage of the present invention to provide a computer system which will interpret, validate, and store all data received at the central dispatch station.

It is yet another object and advantage of the present invention to provide a system that makes available to a dispatch operator all validated data received at the central dispatch station together with any stored information about the individual assigned to the portable signaling unit.

It is a further object and advantage of the present invention to provide a means for displaying the type of alarm and the location of the individual in a convenient format, part of which will display the individual's location on a digitized map, all of which will allow efficient dispatching of appropriate emergency assistance to the exact location of the person in distress in possession of the signaling unit.

It is a still further object and advantage of the present invention to provide a fully automatic personal security system and communication protocol which is operative under the most severe circumstances to automatically summon an emergency response in accordance with the specific personal needs of the person assigned to the portable signaling unit.

It is yet a further object and advantage of the present invention to provide a personal security system as described above which allows the individual to manually summon assistance in an emergency situation.

It is another object and advantage of the present invention to provide a personal security system as described above which may be operated under pre defined or user specified circumstances such as to alert of a health trauma where the individual is able to manually summon assistance.

It is yet another object and advantage of the present invention to provide an automatic means for summoning an emergency response without the necessity of intervention by the individual in distress should the remote alarm switch be removed from the individual by forceful or unauthorized means.

It is a further object and advantage of the present invention to provide an automatic means for summoning an emergency response without the necessity of intervention by the individual in distress should the portable signaling unit be separated from the proximity of the remote alarm switch.

It is a still further object and advantage of the present invention to provide a portable, intelligent signaling unit.

It is yet a further object and advantage of the present invention to provide a signaling unit that can be carried or securely attached to a person without hindering personal activity.

Another object and advantage of the present invention is to provide a personal security system as described above which allows the central dispatch operator to selectively establish two way digital contact with the portable signaling unit.

Yet another object and advantage of the present invention is to provide a personal security system as described above which allows the central dispatch operator to selectively establish two way voice contact with the person carrying the portable signaling unit.

A further object and advantage of the present invention is to provide a personal security system which gives the central dispatch operator control to initiate a request for the locating information.

A still further object and advantage of the present invention is to provide for the central dispatch station to monitor the location of a person within preset boundaries which, when violated, would activate an alarm at the central dispatch station.

Yet a further object and advantage of the present invention is to provide for a reliable remote alarm switch unit that does not need to be continuously transmitting in order to be operational.

It is another object and advantage of the present invention to provide for circuits in the signaling unit not required in the actual sensing of an alarm to remain off or in the standby mode therefore conserving battery power.

It is yet another object and advantage of the present invention to provide a means to alert a dispatch operator of the need for maintenance in the case of a low battery condition in the portable signaling unit.

It is still another object and advantage of the present invention to provide for a reliable personal security and tracking system that can be periodically interrogated and tested for malfunction by the central dispatch station.

It is a further object and advantage of the present invention to provide for a reliable personal security and tracking system that can be periodically interrogated by the central dispatch station to compile historical data.

It is still a further object and advantage of the present invention to provide a signaling unit that is not limited in geographical range.

It is yet a further object and advantage of the present invention to combine the advantages of long range locating and navigation systems, like that used in wireless location technology such as the Automatic Location Identification (ALI) of cellular telephone transmissions, Global Positioning System (GPS) of satellites, LORAN-C, or GLONASS, with the extensive communications capabilities of a wireless communication system, such as a cellular telephone system, digital personal communications system (PCS), or communication satellites, to yield a practical personal security and tracking system with the above described emergency assistance capabilities.

The present invention is a personal security and tracking system that comprises a portable signaling unit and a remote alarm switch unit, each to be worn or carried by an individual being monitored. The system further comprises a central dispatch station to which distress signals and position coordinates are transmitted. The system employs the use of wireless location technology such as the Automatic Location Identification (ALI) of cellular telephone transmissions, Global Positioning System (GPS) of satellites or other types of locating systems, such as LORAN-C or GLONASS, that may perform the function of providing accurate position coordinates. The system further employs a means for data and voice communications between the portable signaling unit and the central dispatch station.

Accordingly, the personal security and tracking system of the present invention provides a reliable personal alarm system for individuals and has the additional advantages in that it quickly and accurately provides a central dispatch operator with information concerning the nature of the alarm and the location of the individual. The system further provides a computer system that will interpret, validate, and store all data received at the central dispatch station that is entered into the computer system, as well as a system that makes available to a dispatch operator all validated data received at the central dispatch station together with any stored information corresponding to the individual assigned to the portable signaling unit, such as subscriber information, emergency telephone numbers, boundary information, etc. that is entered into the computer system.

In addition, the system of the present invention provides a means for displaying to a dispatch operator the type of alarm and the location of the individual in a convenient format, part of which will display the individual's location on a digitized map, all of which will allow efficient dispatching of appropriate emergency assistance to the exact location of the individual in distress in possession of the signaling unit.

The system of the present invention is a fully automatic personal security system and communication protocol that is operative under the most severe circumstances to summon an emergency response automatically in accordance with the specific personal needs of the individual. Optionally, the system allows an individual to manually summon assistance in an emergency situation.

The system may be operated under pre defined standard or user specified circumstances, such as to alert emergency services personnel of a health trauma or a situation in which the remote alarm switch is forcibly removed from the individual, as in a kidnapping. Forceful or unauthorized removal of the remote alarm switch from the individual automatically generates an urgent alarm signal that summons emergency assistance once the remote alarm switch is opened or broken. Additionally, removal of the portable signaling unit from the individual also automatically generates an urgent alarm signal when the portable signaling unit has been removed to a distance where it can no longer sense a periodic signal from the remote alarm switch.

The system of the present invention comprises a small, portable, durable, water proof, intelligent signaling unit that can be securely attached to an individual without hindering personal activity and that is not limited in geographical range. The system provides a reliable alarm switch that does not need to be continuously transmitting to be operational and permits circuits that are not required in the actual sensing of an alarm to remain off or in a standby mode, therefore conserving battery power. The system further provides a means to alert a dispatch operator of the need for maintenance in the case of a low battery condition in the portable signaling unit.

The personal security system of the present invention gives the central dispatch operator the ability to initiate a request for location coordinate information for the individual being monitored. In addition, the system permits the central dispatch station to monitor the location of an individual within predefined boundaries such that, when violated, the system would generate an alarm signal to the central dispatch station. The system further allows a central dispatch operator to selectively establish two way digital contact with the portable signaling unit and, optionally, two way voice contact with the person carrying the portable signaling unit. The system also enables a central dispatch station to periodically interrogate and test the system for malfunction and to compile historical data.

The personal security and tracking system of the present invention combines the advantages of wireless location technology, such as the Automatic Location Identification (ALI) of cellular telephone transmissions, Global Positioning System (GPS) of satellites, LORAN-C, or GLONASS, with the extensive communications capabilities of a wireless communication system, such as a cellular telephone system, digital personal communications system PCS), or communication satellites, to yield a practical personal security and tracking system with the above described emergency assistance capabilities.

It should be noted that the invention is not limited to the security and tracking of a person. The invention is capable of protecting the security of animals and inanimate objects. The invention can pinpoint and monitor the location of anything capable of carrying a portable signaling unit due to the fact that it can be interrogated by the central dispatch station.

The system of the present invention may additionally be integrated with existing Emergency Locator Transponder (ELT) systems, which are used to locate downed aircraft by providing the geographic location (i.e., latitude and longitude) of the aircraft.

The above described and other objects, features, and advantages of the present invention will become more apparent from the following detailed description of the preferred embodiments and certain modifications thereof when taken together with the accompanying drawings in which:

DRAWING FIGURES

FIGS. 8A and 8B show various situations, alarm activation methods and the associated information received, displayed and stored at the central dispatch station.

DETAILED DESCRIPTION OF EMBODIMENTS

Figure 1:
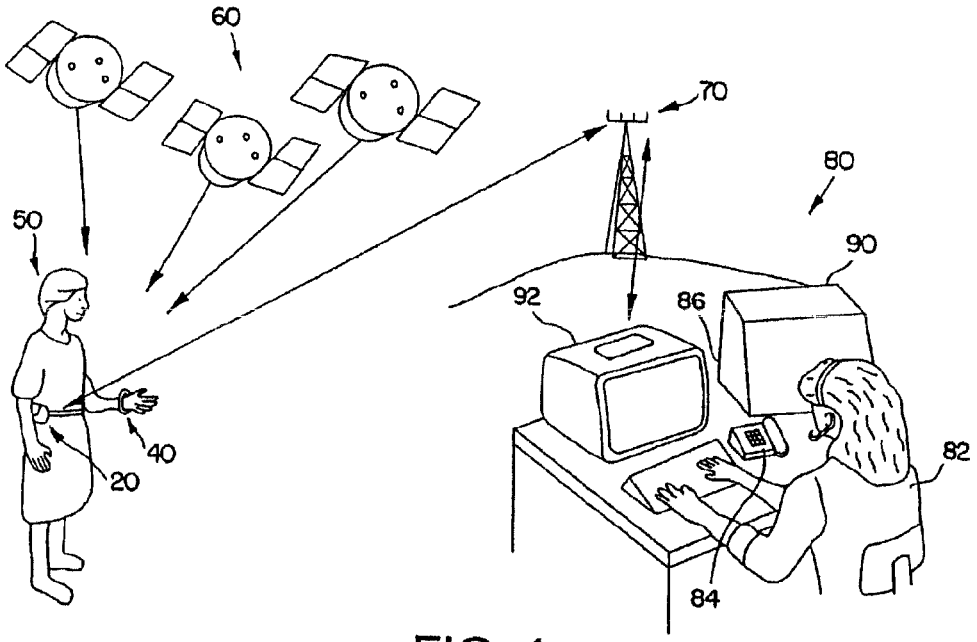
FIG. 1 is a schematic of a personal security and tracking system in accordance with an embodiment of the present invention.

Referring to FIG. 1, the personal security and tracking system according to the present invention generally includes a portable signaling unit 20 and a remote alarm switch unit 40 shown here in a configuration of a wristband. Either or both of portable signaling unit 20 and remote alarm switch unit 40 can be worn or carried by an individual 50 being monitored.

The personal security and tracking system shown in FIG. 1 employs, as part of cellular telephone system 70, wireless location technology, such as a cellular telephone Automatic Location Identification (ALI) system, in order to identify the origination location of an alarm signal generated by portable signaling unit 20 in response to a triggering of remote alarm switch unit 40. It should be appreciated by one skilled in the art that other types of locating systems, such as a Global Positioning System (GPS), LORAN-C, or GLONASS, may perform the function of providing accurate position coordinates and may be substituted therefor. Hence, the present invention should not be construed as limited to ALI.

A cellular telephone system 70 provides a means for data and voice communications between the portable signaling unit 20 and a central dispatch station 80. The cellular telephone system 70 may be any conventional cellular telephone system. It should also be appreciated by one skilled in the art that other types of communication devices such as satellite transceivers or any other two way wireless communication system may perform the function of the cellular telephone system 70 and may easily be substituted therefor. Hence, the present invention should not be construed as limited to a cellular telephone system.

The portable security and tracking system also includes a central dispatch station 80. The central dispatch station 80 is manned by one or more dispatch operators 82 and includes an intelligent telephone system 84, one or more data modems 86, a computer system 90, and one or more display consoles 92. The computer system 90 comprises means to store and access communications information, a user database, an emergency services database, map display information, and unit identifier and alarm status display information. The computer system 90 further comprises one or more data-to-voice switches and has remote activation capability, plotting algorithms, boundary monitoring alarm features, and the capability to store and retrieve historical data. In a preferred embodiment, display console 92 displays the alarm signal origination location, the user identification, and an alarm code, as described in FIG. 7. A number of suitable map programs incorporating many of these features are commercially available and suitable for use with the present invention.

Figure 2:
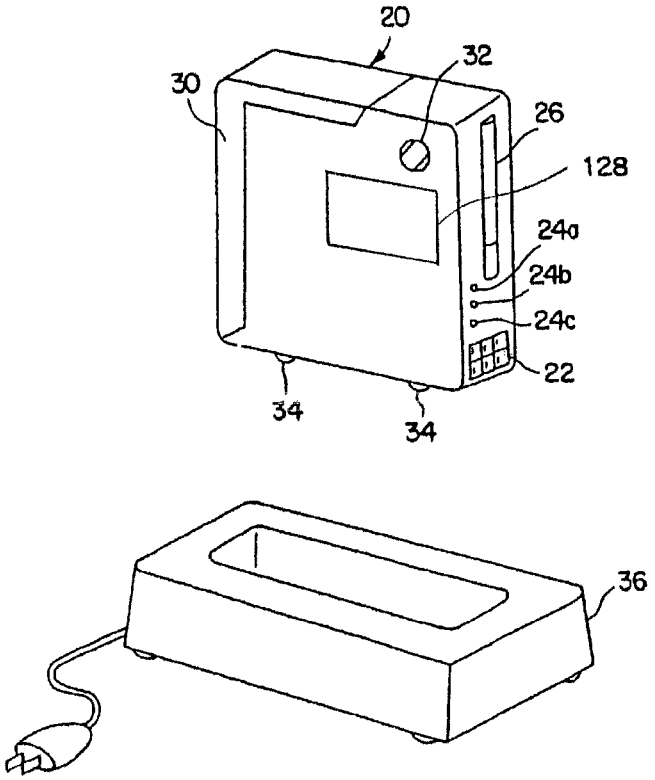
FIG. 2 is a perspective drawing of a portable signaling unit which is included in the personal security and tracking system of FIG. 1.

FIG. 2 shows a portable signaling unit 20 that includes a main power on off keypad 22. Local alarm push button switches 24*a*, 24*b*, 24*c*, etc. allow the use of the portable signaling unit 20 by campers, hikers, or skiers, etc., when the additional features of the remote alarm switch unit 40 may not be required. A cellular telephone antenna 26 is embodied in the casing of the signaling unit 20. In another variation, a GPS receiving antenna 30 could also be embodied in the outer part of the casing of signaling unit 20 when a GPS receiver is used for determining the location of the signaling unit. A speaker microphone element 32 gives the central dispatch operator 82 the option to conduct two way voice communications with the individual in distress. Two electrical contacts 34 are mounted to the base for use with a drop in battery charger 36, as known in the art of portable communications systems. Portable signaling unit 20 can be manufactured in various configurations for attaching it securely to the individual 50, including by use of a belt, belt clip, or carry strap. Another variation of the configuration could incorporate a sensor to detect if the portable signaling unit 20 was involuntarily removed from the individual and would automatically trigger an alarm signal to the central dispatch station.

Figure 3B:
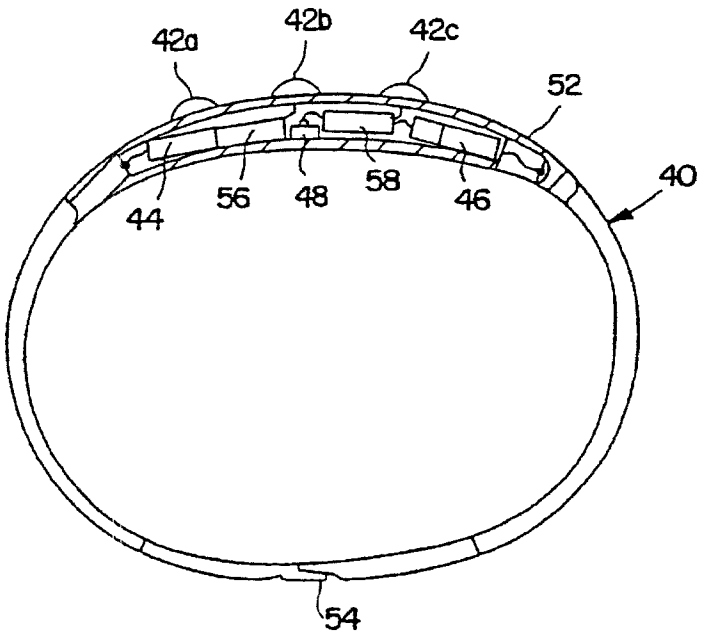
FIGS. 3A and 3B are perspective drawings of a remote alarm switch unit which is included in the personal security and tracking system of FIG. 1.
Figure 3A:
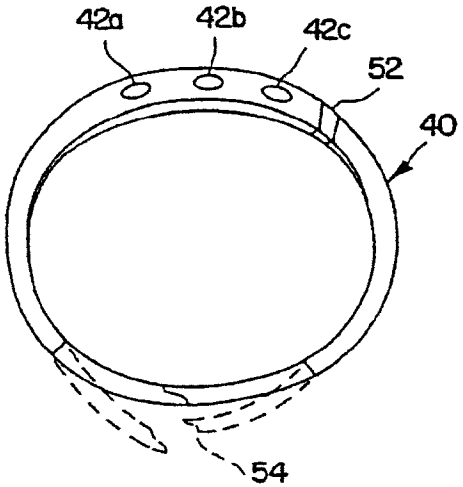

FIGS. 3A and 3B show one embodiment of the remote alarm switch unit 40 in the form of a wristband assembly. Remote alarm switch unit 40 can be in the form of any other object, such as a broach, pendant, or keychain. Regardless of its construction, remote alarm switch unit 40 comprises a series of manual alarm push buttons 42*a*, 42*b*, 42*c*, etc. These manual alarm push buttons can be marked with different symbols and/or color codes for easy reference by the user. For example, green, yellow and red may be used to indicate increasing order of alarm priority.

Remote alarm switch unit 40 further comprises a miniature radio transmitter having a built in antenna 46, a lithium battery 48, an encoder circuit 58, and an automatic switch circuit 44 that is activated if remote alarm switch unit 40 is removed from individual 50 by forceful or unauthorized means. In the wristband configuration of remote alarm switch unit 40 as shown, a section of insulation material 52, e.g., non-electroconductive plastic, is provided so that the clasp portion 54 of the wristband can provide a closed circuit to the automatic alarm switch circuit 44. These components enable remote alarm switch unit 40 to automatically generate a signal if the circuit is determined to be open (e.g., when the remote alarm switch unit 40 is unintentionally removed from the individual).

Remote alarm switch unit 40 also comprises a timer circuit 56, which enables remote alarm switch unit 40 to transmit a periodic signal so that portable signaling unit 20 can determine that remote alarm switch unit 40 is within the preset location range of portable signaling unit 20 (i.e., a "normal" condition: the portable signaling unit 20 is still being worn or carried by the individual).

Further, remote alarm switch unit 40 contains circuitry that enables remote alarm switch unit 40 to be in a non¬ transmitting mode when in a non triggered state, except during transmission of the periodic signals. In this way, battery power is conserved, unlike where remote alarm switch unit 40 is continuously transmitting in the triggered state.

In practice, the central dispatch station 80 will interpret an alarm signal generated by portable signaling unit 20 when portable signaling unit 20 fails to receive a periodic signal from remote alarm switch unit 40 as indicating that remote alarm switch unit 40 is not within the preset location range of portable signaling unit 20. Since the central dispatch station 80 has not received an alarm indication that remote alarm switch unit 40 has been removed from the individual by forceful or unauthorized means, it must be that portable signaling unit 20 has been removed from the individual.

Figure 4:
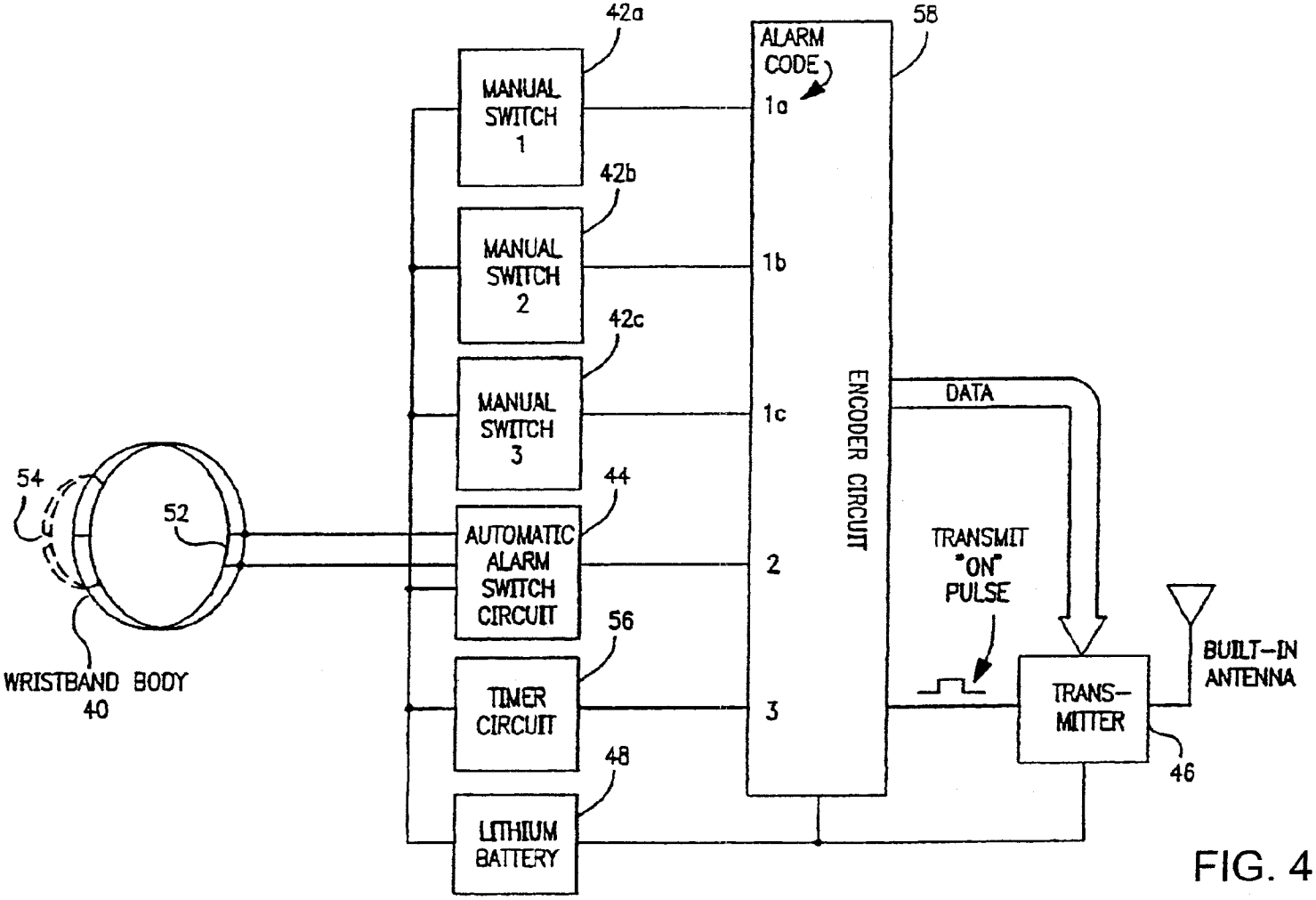
FIG. 4 is a block diagram of the major circuit components in the remote alarm switch unit of FIGS. 3A and 3B.

FIG. 4 shows a functional block diagram of the circuits in the remote alarm switch unit 40. The various manual alarm switches 42*a*, 42*b*, and 42*c* are shown. Also shown are automatic alarm switch circuit 44, encoder circuit 58, timer circuit 56, miniature radio transmitter having a built in antenna 46, and lithium battery 48.

Figure 5:
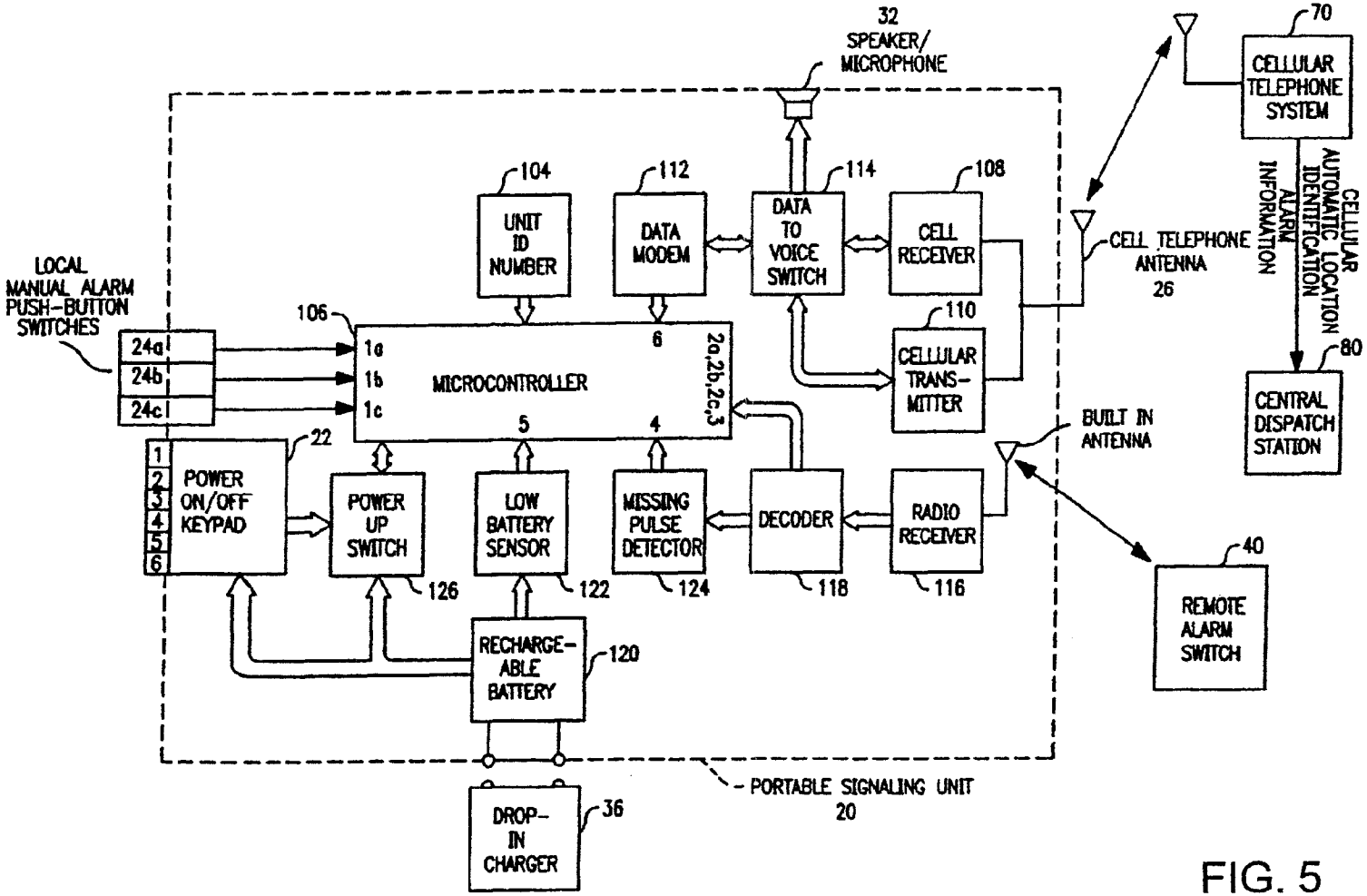
FIG. 5 is a block diagram of the major circuit components in the personal security and tracking system of FIG. I including a detailed block diagram of the portable signaling unit of FIG. 2.

FIG. 5 shows a system block diagram which includes portable signaling unit 20, drop in battery charger 36, a cellular telephone system 70 with wireless location technology such as a cellular telephone Automatic Location Identification (ALI) system, remote alarm switch unit 40, and central dispatch station 80. Contained within the portable signaling unit 20 are 3 local alarm switches 24*a*, 24*b*, 24*c*, a programmed unit serial identification code circuit 104, a microcontroller 106, a cellular telephone receiver 108 with a pre assigned telephone number, a cellular telephone antenna 26, and a cellular telephone transmitter 110. The cellular telephone circuit 110 also comprises a pre programmed telephone number for the central dispatch station 80, a redial counter, and alternate telephone numbers to provide for failsafe operation. Also included in the portable signaling unit are a data modem 112, a data-to-voice switching circuit 114, a remote alarm radio receiver with built in antenna 116, a decoder circuit 118, a speaker microphone element 32, a rechargeable battery 120, a low battery sensor circuit 122, a missing pulse detector 124, and a power up switch circuit 126.

Figure 6:
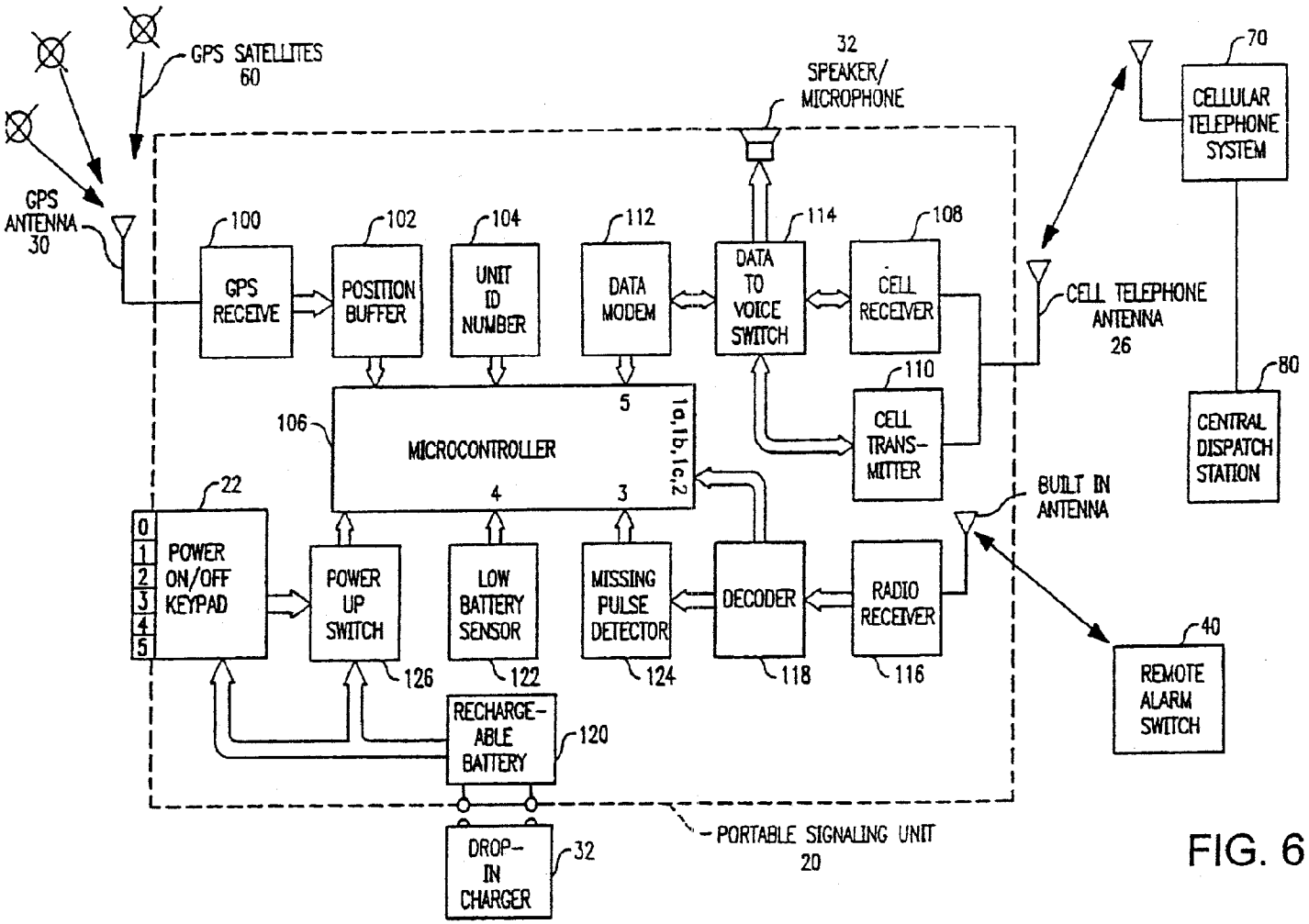
FIG. 6 is a block diagram of the major circuit components in an alternate embodiment of the personal security and tracking system of FIG. 1 including a detailed block diagram of the portable signaling unit of FIG. 2.

FIG. 6 shows an alternative system block diagram which incorporates the use of GPS satellite network 60, a GPS receiving antenna 30, a GPS receiving circuit 100, and a position buffer circuit 102, in association with the circuits described above with reference to FIG. 5.

The general method of operation of the personal security tracking system is described as follows:

The portable signaling unit 20 can be worn or carried by the user, preferably under the wearer's clothing so as to not be visible to a possible perpetrator.

As shown in FIG. 5, the portable signaling unit 20 is first put into service by an authorized person, parent, or guardian who enters a security code at the main power on/off key pad 22. The portable signaling unit 20 is now in a stand by mode so as to conserve battery power. In the stand by mode only those circuits essential to sensing an alarm condition are powered on. These essential circuits include remote alarm radio receiver 116, decoder circuit 118, missing pulse detector 124, cellular telephone receiving circuit 108, data modem circuit 112, microcontroller 106 and a low battery sensing circuit 122. The microcontroller 106 continuously polls the alarm inputs to detect a change in security conditions. It also commands and directs circuit operations. The data-to-voice switch circuit 114 remains in the data mode and cannot be switched to the voice mode until it receives the power up command. The remainder of the circuits remain off until an alarm input is detected.

As shown in FIG. 8 the portable signaling unit 20 is activated to the alarm mode when any one of the following conditions prevail:

(a) When the person in distress has enough control in the situation to manually activate the portable signaling unit 20 (FIG. 2).

This is done by depressing any one of the manual push-button switches 24*a*, 24*b*, 24*c*, etc. on the portable signaling unit 20. The selection of the proper manual push button switches 24*a*, 24*b*, 24*c*, etc. is related to various health conditions or a threat to the individual's personal safety, based on a pre arranged agreement with the central dispatch station. E.g., depressing manual alarm push button switch 24*c* can mean "I'm okay, just checking in, as pre arranged", depressing manual alarm push button switch 24*b* can mean "I am in need of medical assistance", and depressing manual alarm push button switch 24*a* can mean "Help, my life is in danger!"

Referring to FIG. 5, depressing any one of the push¬ button switches 24*a*, 24*b*, 24*c*, etc. on the portable signaling unit 20 sends a signal to microcontroller 106 and sets alarm input number 1*a*, 1*b*, 1*c*, etc. corresponding to the manual switch that was depressed.

(b) When the person in distress has enough control in the situation to manually activate the remote alarm switch unit 40 (FIGS. 3A and 3B).

This is done by depressing any one of the manual push-button switches 42*a*, 42*b*, or 42*c*, etc. The selection of the proper manual alarm push button switch 42*a*, 42*b* or 42*c*, etc., is related to various, health conditions or a threat to the individual's personal safety, as described in paragraph (a) above.

Referring to FIG. 4, depressing any one of the push button switches 42*a*, 42*b*, or 42*c*, etc. on the remote alarm switch unit 40 sends a pulse to the encoder circuit 58. The encoder circuit 58 then sends a uniquely coded data pulse and a transmit "on" command to the miniature radio transmitter 46. In FIG. 5, a radio frequency signal, with the unique code denoting which manual switch was depressed, is sent from the remote alarm switch unit 40 to the portable signaling unit 20. The signal is detected by the remote alarm radio receiver 116 and decoded by the decoder circuit 118. Decoder 118 sets alarm input number 2*a*, 2*b*, or 2*c*, etc. in the microcontroller 106 corresponding to the manual switch that was depressed in the remote alarm switch unit 40. Coding and decoding the remote alarm switch unit 40 signal will prevent false triggering of the portable signaling unit 20 from other stray and random radio frequency sources.

(c) When the remote alarm switch unit 40 is removed from the individual 50 by forceful or unauthorized means before the individual is able to summon help.

In FIG. 4, the automatic alarm switch circuit 44 is activated when, in this example, the wristband clasp assembly 54 is opened, or if the wristband is cut or broken. In either case, the automatic alarm switch circuit 44 senses that electrical continuity around the wristband is broken creating an open electrical circuit. The automatic alarm switch circuit 44 then sends a pulse to the encoder circuit 58. The encoder circuit 58 sends a uniquely coded pulse and a transmit "on" command to the miniature radio transmitter 46. In FIG. 5, a radio frequency signal, with the unique code denoting the automatic alarm switch circuit 44 activation, is sent to the portable signaling unit 20. The signal is detected by remote alarm radio receiver 116 and decoded by decoder circuit 118. Decoder 118 sets alarm input number 3 in the microcontroller 106.

(d) When the portable signaling unit 20 is removed from the individual 50 by forceful or unauthorized means before the individual can summon help.

A feature of the portable security and tracking system provides for detecting the separation of the portable signaling unit 20 from the remote alarm switch unit 40. A scenario might be where the portable signaling unit 20 is removed from the individual 50 by a perpetrator and discarded and the remote alarm switch (in the form of a wristband for example) is untouched. Its operation is described as follows:

The portable signaling unit 20 must receive a radio frequency signal from the remote alarm switch unit 40 at a predetermined time interval. A failure to receive this signal will activate the portable signaling unit 20 to transmit an alarm. This failure to receive the signal may be when the distance between the portable signaling unit 20 and the remote alarm switch unit 40 becomes too great to detect the signal or it may be caused by a battery or transmitter failure in the remote alarm switch unit 40.

In FIG. 4, the timer circuit 56 in remote alarm switch unit 40 sends a pulse to the encoder circuit 58 at a predetermined time interval, e.g., once every minute. The encoder circuit 58 sends a uniquely coded pulse and a short transmit "on" command to the miniature radio transmitter 46.

In FIG. 5, a radio frequency signal, with a unique code denoting a timer circuit activation, is sent to the portable signaling unit 20. The signal is detected by remote alarm radio receiver circuit 116 in the portable signaling unit 20. The unique code is decoded by the decoder circuit 118 and sent to missing pulse detector circuit 124. If missing pulse detector 124 fails to be reset within a predetermined time interval by the periodic signal, e.g., 1.5 minutes, then alarm input number 4 is set in microcontroller 106. The separation distance at which the portable signaling unit 20 is activated is set by adjusting the power output of the miniature radio transmitter 46 in the remote alarm switch unit 40.

(e) When a low battery condition is sensed by the low battery sensor circuit 122.

In FIG. 5, the low battery sensor circuit 122 is preset to allow a sufficient amount of remaining battery voltage to ensure reliable activation of the portable signaling unit 20. When the voltage drops below a preset voltage threshold, alarm input flag number 5 is set in the microcontroller 106.

(f) When the portable signaling unit 20 needs to be located and/or monitored.

Figure 7:
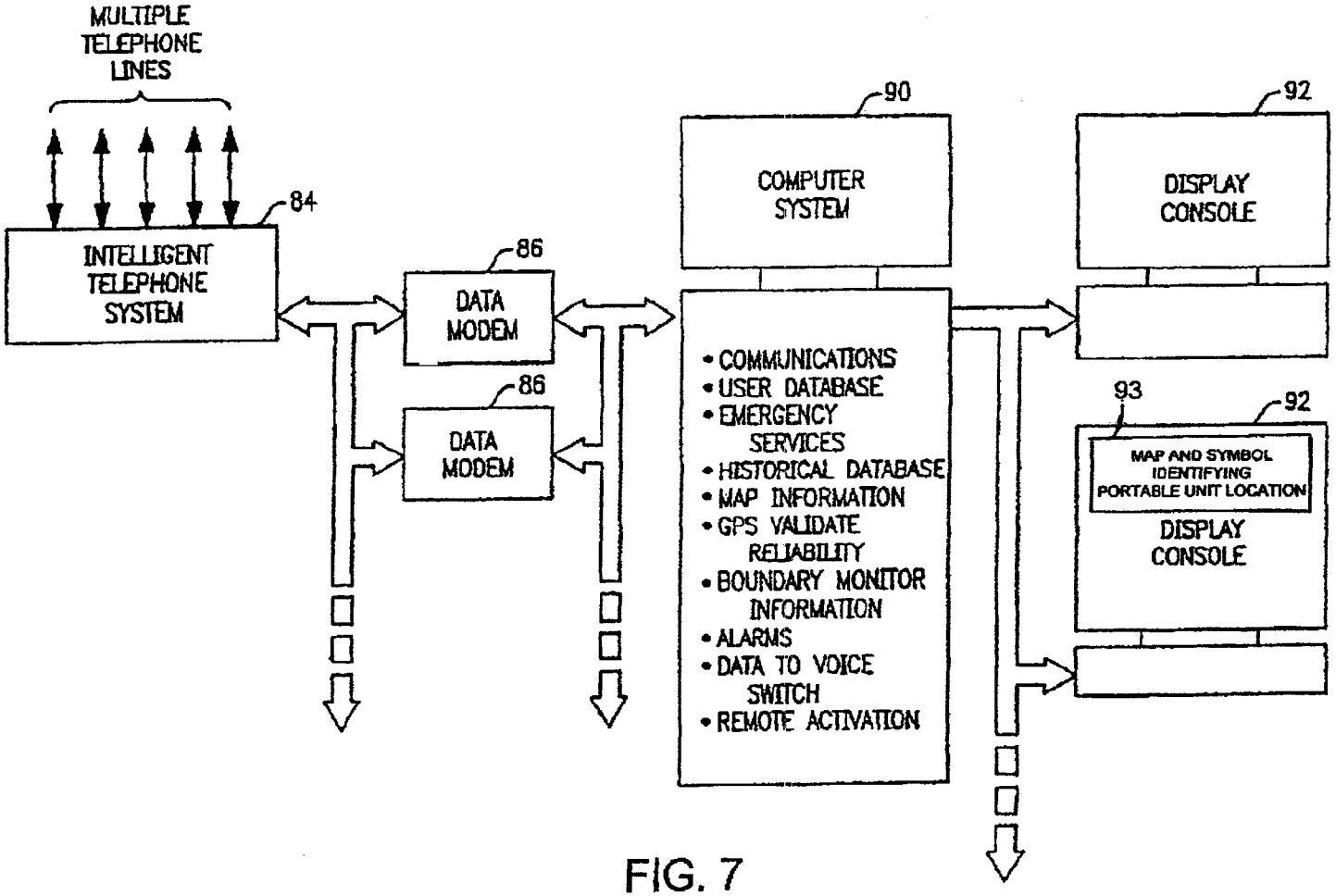
FIG. 7 is a block diagrams showing the functional components of a central dispatch station employed by the present invention.

Referring to FIG. 7, the central dispatch station operator 82 locates the subscriber information including the telephone number of portable signaling unit 20 in the computer system 90 database. The remote activation capability in the computer system 90 is then used to automatically dial the portable signaling unit 20 and transmit a cellular digital packet data (CDPD) transmission via the cellular telephone system 70 to the individual's portable signaling unit 20. In FIG. 5, upon receiving the telephone CDPD transmission, cellular telephone receiver circuit 108 sends the received data through the data modem circuit 112 which sets alarm input number 6 in the microcontroller 106.

Upon sensing any one of the above described alarm input conditions, the microcontroller 106, then turns on the remainder of the circuits within the portable signaling unit 20 by activating power up switch circuit 126.

As shown in FIG. 5, the programmed unit identification code circuit 104, the cellular telephone transmitter circuit 110 and the data-to-voice switching circuit 114 are turned on.

FIG. 6 shows a variation of signaling unit 20 which incorporates a GPS receiver to determine the user's location. In this variation, the GPS receiver 100 and the position buffer circuit 102 are also turned on upon sensing any one of the above described alarm input conditions.

In the case of alarm conditions described in (a) through (d), above, the microcontroller 106 commands the cellular telephone transmitter circuit 110 to automatically dial the central dispatch station 80. The central dispatch station 80 receives the incoming signal and returns a CDPD transmission requesting the portable signaling unit 20 to send its data. The portable signaling unit 20 replies with a CDPD transmission consisting of its unit identification number and the alarm code. In the case where a GPS receiver is used to determine location, a hierarchy of longitude and latitude coordinate data is also included in the CDPD transmission to the central dispatch station 80.

In the case of (e) above, when the cellular telephone transmitter circuit 110 is activated, the microcontroller 106 then sends a CDPD transmission consisting of its unit identification number and the alarm code. In the case where a GPS receiver is used to determine location, a hierarchy of longitude and latitude coordinate data is also included in the CDPD transmission to the central dispatch station 80.

In FIG. 7, the central dispatch station 80 receives the incoming CDPD transmission from the portable signaling unit 20 to the intelligent telephone system 84 via the cellular telephone system 70. The cellular telephone system 70 provides Automatic Location Identification (ALI) information that gives the location of the origin of the cellular telephone transmissions. This technology has been developed by companies such as XYPOINT and The Associated Group (TruePosition™), in response to a Federal Communications mandate (Report and Order 94 102) that requires E9-1-1 cellular telephone calls be located to within 125 meters (410 feet) of the origination point at a 67% or better accuracy rate.

The signal is routed to a computer system 90 via one or more data modems 86 and is automatically verified by the computer system 90. Upon verification, an acknowledgment CDPD transmission is sent back to the portable signaling unit 20 confirming that two way communications has been established. Should an incoming cellular telephone call be a wrong number, the proper signal will not be detected, the cellular telephone transmitter circuit 110 will time out and will automatically hang up. Once the communications link has successfully been established between the portable signaling unit 20 and the central dispatch station 80, the portable signaling unit 20 is automatically instructed by the computer system 90 to continue sending CDPD transmissions.

FIG. 7 is a block diagram of the presently preferred embodiment of the central dispatch station 80. The central dispatch station 80 generally comprises a conventional intelligent telephone system 84 connected to one or more data modems 86 then to a computer system 90 which in turn is connected to one or more display consoles 92. The computer system 90 contains the communications information, user database, emergency services database, map display information, unit identifier and alarm status display information, one or more data-to-voice switches, remote activation capability, plotting algorithms, boundary monitoring alarm features, and has the capability to store and retrieve historical data. The computer system 90 can be networked so that incoming personal alarm messages may be allocated to the appropriate display consoles 92 to accommodate a high frequency of incoming calls. The computer system 90 and display consoles 92 may be any commercially available brand of microprocessor which includes video monitors.

Incoming cellular calls from portable signaling unit 20 are automatically received and logged by the computer system 90 (via the intelligent telephone system 84 and one or more data modems 86). The CDPD transmissions along with the ALI information are decoded, validated and routed to display console(s) 92. The display console(s) 92 continuously run a conventional digital map program. Preferably, the map program is capable of (a) displaying detailed geographical area maps complete with street names and addresses, (b) real time plotting of coordinates data at the appropriate position on the map, (c) a user controlled zoom function, and (d) programmable display windows, symbols, and legend. A number of suitable map programs incorporating these features are commercially available.

Computer system 90 processes and validates the received data. The portable signaling unit identification number is matched with the subscriber name in the database. The alarm code information is decoded and recorded. The ALI location data is analyzed for reliability and stored. The location of portable signaling unit 20 is displayed on one of the display consoles 92 in the form of a quickly recognizable symbol. The symbol can represent police, medical or any other key feature that may apply to the specific needs of the subscriber. The symbol appears superimposed on a digitized map on a computer monitor screen 92 at a position which corresponds to the location of the portable signaling unit 20. Both the user identification data and alarm code are also displayed on the display console 92. A data-to-voice switch capability in the computer system 90 allows the central dispatch operator 82 to conduct two way communications with the person in distress via the portable signaling unit 20. Various display capabilities are utilized to assist a dispatch operator 82 in locating the person in distress. The emergency services database allows a dispatch operator 82 to automatically dial the proper authorities and direct them to the exact location of the person to provide emergency assistance. The data is updated and transmitted at regular intervals until the connection is terminated by a dispatch operator 82. An important feature of the personal security and tracking system is that when a low battery condition alarm is indicated from the portable signaling unit 20, an alarm is activated at the central dispatch station 80. A dispatch operator then notifies the designated person (e.g., parent or guardian) to service the battery.

As described in FIG. 8, situation number 6, the central dispatch station can activate any portable signaling unit 20 to obtain an instant display of the current location of the individual carrying the portable signaling unit 20. This activation would be on an "as needed" basis. For example, if a parent or guardian needed to determine the location of a lost person.

In the case where an individual is to be monitored for compliance within a preset boundary as described in FIG. 8, situation number 7, the portable signaling unit 20 is automatically interrogated by the computer system 90 at predetermined time intervals. Should a CDPD transmission from the portable signaling unit yield data that is outside specified boundaries, the computer system 90 will activate an alarm to a dispatch operator 82.

Also in FIG. 8, situation 8 describes the self check capability of the personal security and tracking system of FIG. 1. The computer system 90 at the central dispatch station 80 can be programmed to automatically interrogate each portable signaling unit 20 at predetermined time intervals. The computer system 90 activates an alarm to a dispatch operator 82 if there is no response or if invalid data is received indicating a malfunction.

Although the description above contains many specifics, these should not be construed as limiting the scope of the invention but as merely providing illustrations of some of the presently preferred embodiments of this invention. For example, the remote alarm switch unit 40 can be in the form of a wristband as described here or in the form of any other object, such as a broach, pendant, or keychain. The same arrangement of manual and automatically activated alarm switches could be incorporated in any design configuration. The portable signaling unit 20 can contain a GPS receiving circuit as described herein to provide more accurate location information in open areas where the cellular telephone ALI information may not be as precise. The portable signaling unit 20 can be configured such that it has all of the features of the remote alarm switch unit 40 in addition to its own features, with the exception of the distance checking feature. The portable signaling unit 20 can also be configured with a small LCD display screen 128 for the hearing impaired to receive messages from the central dispatch station. Thus the scope of the invention should be determined by the appended claims and their legal equivalents rather than by the examples given.

What is claimed is:

1. A portable signaling unit comprising:

a speaker;

a microphone;

a display;

a microcontroller;

a user interface;

a transmitter adapted to transmit first signals via a network;

a first receiver adapted to receive a second signal via the network; and a second receiver adapted to receive a third signal other than the first signals and second signal, wherein the third signal is other than from the network;

wherein the transmitter is adapted to transmit data;

wherein the transmitter is adapted to transmit signals representing a user's voice;

wherein the portable signaling unit is adapted to receive a security code via the user interface; and wherein the display is adapted to display a message received by the portable signaling unit via the first receiver.

2. The portable signaling unit of claim 1 further comprising a GPS receiver to receive a GPS signal.

3. The portable signaling unit of claim 2 wherein the data transmitted by the transmitter contains location information based on the GPS signal received by the GPS receiver.

4. The portable signaling unit of claim 3 wherein the transmission of the data containing location information is initiated by the portable signaling unit.

5. The portable signaling unit of claim 3 wherein the transmission of the data containing location information is initiated in response to a signal received via the network.

6. The portable signaling unit of claim 3 wherein the portable signaling unit is adapted to initiate transmission of the data containing location information and the portable signaling unit is adapted to transmit the data containing location information in response to a signal received via the network.

7. The portable signaling unit of claim 1 wherein the second receiver is a GPS receiver.

8. The portable signaling unit of claim 7 wherein the transmitter transmits location information based on a GPS signal received by the GPS receiver.

9. The portable signaling unit of claim 7 further adapted to receive a fourth signal that is other than a signal from the network.

10. The portable signaling unit of claim 1 wherein the second receiver is adapted to receive a signal that is other than a signal from the network or a signal from a global positioning satellite.

11. The portable signaling unit of claim 1 further comprising:

a housing comprising a first surface and a second surface, the second surface different from the first surface, and wherein the user interface is positioned on the first surface;

the speaker positioned on the housing;

the microphone positioned on the housing;

a charging interface positioned on the housing;

the housing further adapted to include:

the microcontroller;

the transmitter;

the first receiver;

the second receiver;

a rechargeable battery;

wherein the third signal is a radio signal;

wherein the transmitter is a wireless transmitter;

wherein the first receiver is a wireless receiver; and wherein the third signal is other than a GPS (Global Positioning System) signal and the second receiver is other than a GPS receiver.

12. The portable signaling unit of claim 11 wherein the microphone is positioned on the second surface.

13. The portable signaling unit of claim 12 wherein the portable signaling unit further comprises a first antenna contained within the housing.

14. The portable signaling unit of claim 13 wherein the portable signaling unit further comprises a second antenna.

15. The portable signaling unit of claim 14 wherein the second antenna is integrated into the housing.

16. The portable signaling unit of claim 11 wherein the portable signaling unit transmits the first signal via the network using the transmitter in response to receiving first encoded data by the second receiver and the portable signaling unit does not transmit the first signal via the network using the transmitter in response to receiving second encoded data by the second receiver.

17. The portable signaling unit of claim 16 wherein the first encoded data represents an actuation of a first button on a transmitting device separate from the portable signaling unit.

18. The portable signaling unit of claim 17 wherein the second encoded data represents the actuation of a second button on the transmitting device.

19. The portable signaling unit of claim 18 wherein the portable signaling unit is adapted to receive third encoded data via the second receiver, the third encoded data is different from the first encoded data and different from the second encoded data.

20. The portable signaling unit of claim 19 wherein the third encoded data represents the actuation of a third button on the transmitting device.

21. The portable signaling unit of claim 11 wherein the second receiver is adapted to receive a periodic signal from a transmitting device separate from the portable signaling unit and transmitting the third signal.

22. The portable signaling unit of claim 11 wherein the radio signal is from a transmitting device separate from the portable signaling unit and within a range of the portable signaling unit, the range corresponding to a distance between the transmitting device and the portable signaling unit when both the transmitting device and the portable signaling unit are worn or carried by an individual.

23. The portable signaling unit of claim 11 wherein the portable signaling unit determines an absence of the third signal.

24. The portable signaling unit of claim 23 wherein an input to the microcontroller is set in the absence of the third signal.

25. The portable signaling unit of claim 11 wherein the charging interface is positioned on the second surface.

26. The portable signaling unit of claim 11 wherein the user interface is powered off to conserve power.

27. The portable signaling unit of claim 26 wherein the second receiver is adapted to receive first encoded data and second encoded data and the user interface is not powered on in response to receipt of the first encoded data.

28. The portable signaling unit of claim 27 wherein the user interface is powered on in response to receipt of the second encoded data.

29. The portable signaling unit of claim 28 wherein the user interface is powered on in response to receipt by the first receiver of the second signal from the network.

30. The portable signaling unit of claim 26 wherein the second receiver is adapted to receive first encoded data and second encoded data and the user interface is powered on in response to receipt of the second encoded data.

31. The portable signaling unit of claim 26 wherein the second receiver is adapted to receive first encoded data and second encoded data and the user interface is powered on in response to receipt by the first receiver of the second signal from the network.

32. The portable signaling unit of claim 11 wherein the microphone is powered off to conserve power.

33. The portable signaling unit of claim 32 wherein the second receiver is adapted to receive first encoded data and second encoded data and the microphone is not powered on in response to receipt of the first encoded data.

34. The portable signaling unit of claim 33 wherein the microphone is powered on in response to receipt of the second encoded data.

35. The portable signaling unit of claim 34 wherein the microphone is powered on in response to receipt by the first receiver of the second signal from the wireless network.

36. The portable signaling unit of claim 33 wherein the microphone is powered on in response to receipt of the second encoded data.

37. The portable signaling unit of claim 32 wherein the microphone is powered on in response to receipt by the first receiver of the second signal from the wireless network.

38. The portable signaling unit of claim 11 wherein the housing comprises a third surface, the third surface different from the first surface and the second surface, and wherein the charging interface is positioned on the second surface and the microphone is positioned on the third surface.

39. The portable signaling unit of claim 11 wherein the housing comprises a third surface, the third surface different from the first surface and the second surface, and wherein the charging interface is positioned on the second surface and the speaker is positioned on the third surface.

40. The portable signaling unit of claim 11 wherein the speaker is positioned on the second surface.

41. The portable signaling unit of claim 11 wherein the network is a cellular network.

42. The portable signaling unit of claim 11 wherein the wireless transmitter is adapted to establish a connection with the network to transmit data.

43. The portable signaling unit of claim 11 wherein the portable signaling unit further comprises circuitry adapted to store a unit identifier number for the portable signaling unit.

44. The portable signaling unit of claim 11 further comprising a decoder adapted to decode signals received via the second receiver.

45. The portable signaling unit of claim 44 wherein the decoder is separate from the microcontroller.

46. The portable signaling unit of claim 11 further comprising circuitry adapted to determine whether the second receiver is receiving the third signal.

47. The portable signaling unit of claim 46 wherein the circuitry is separate from the microcontroller.

48. The portable signaling unit of claim 11 further comprising:

a wireless GPS (Global Positioning System) receiver;

wherein the portable signaling unit is adapted to establish two-way voice communications using the transmitter and the first receiver;

wherein the portable signaling unit is adapted to receive via the first receiver: i) a first encoded data comprising a first code and ii) a second encoded data comprising a second code, the second code different from the first code; and wherein the second receiver is adapted to receive a radio signal.

49. The portable signaling unit of claim 11 wherein the third signal received by the second receiver is a periodic signal.

50. The portable signaling unit of claim 49 wherein the portable signaling unit is adapted to decode the periodic signal.

51. The portable signaling unit of claim 50 wherein the portable signaling unit is adapted to determine whether the periodic signal has not been received.

52. The portable signaling unit of claim 51 wherein the portable signaling unit is adapted to determine whether the periodic signal has not been received within a predetermined time interval.

53. The portable signaling unit of claim 49 wherein:

the portable signaling unit is adapted to determine a presence or an absence of the periodic signal within a first predetermined time interval; and when the portable signaling unit determines the presence of the periodic signal within the first predetermined time interval:

the portable signaling unit is adapted to determine a presence or an absence of the periodic signal within a subsequent, second predetermined time interval.

54. The portable signaling unit of claim 49 wherein the portable signaling unit includes circuitry adapted to detect the reception of the periodic signal by the portable signaling unit; wherein the circuitry sets an input to the microcontroller after a predetermined time interval; wherein the periodic signal resets the circuitry if the periodic signal is received during the predetermined time interval.

55. The portable signaling unit of claim 1 wherein the third signal received by the second receiver is a periodic signal.

56. The portable signaling unit of claim 55 wherein the portable signaling unit is adapted to decode the periodic signal.

57. The portable signaling unit of claim 56 wherein the portable signaling unit is adapted to determine whether the periodic signal has not been received.

58. The portable signaling unit of claim 57 wherein:

the portable signaling unit is adapted to determine a presence or an absence of the periodic signal within a first predetermined time interval; and when the portable signaling unit determines the presence of the periodic signal within the first predetermined time interval:

the portable signaling unit is adapted to determine a presence or an absence of the periodic signal within a subsequent, second predetermined time interval.

59. The portable signaling unit of claim 55 wherein the portable signaling unit is adapted to determine whether the periodic signal has not been received within a predetermined time interval.

* * * * *